US010490370B2

(12) United States Patent
Kim et al.

(10) Patent No.: US 10,490,370 B2
(45) Date of Patent: Nov. 26, 2019

(54) EMERGENCY STOP APPARATUS AND METHOD

(71) Applicant: AP SYSTEMS INC., Hwaseong-Si, Gyeonggi-Do (KR)

(72) Inventors: Kwang Soo Kim, Osan-Si (KR); Jong Gwon Choi, Suwon-Si (KR); Hyun Sik Yun, Pyeongtaek-Si (KR); Joo Hyeok Baek, Osan-Si (KR)

(73) Assignee: AP SYSTEMS INC. (KR)

( * ) Notice: Subject to any disclaimer, the term of this patent is extended or adjusted under 35 U.S.C. 154(b) by 0 days.

(21) Appl. No.: 15/883,063

(22) Filed: Jan. 29, 2018

(65) Prior Publication Data

US 2018/0240623 A1 Aug. 23, 2018

(30) Foreign Application Priority Data

Feb. 21, 2017 (KR) ..... 10-2017-0023117

(51) Int. Cl.

| | |
|---|---|
| ***H01H 17/08*** | (2006.01) |
| ***H01H 17/16*** | (2006.01) |
| ***H01H 3/02*** | (2006.01) |
| ***H01H 89/00*** | (2006.01) |
| *H01H 9/16* | (2006.01) |
| *H01H 17/10* | (2006.01) |
| *H01H 3/32* | (2006.01) |

(52) U.S. Cl.

CPC ..... *H01H 17/08* (2013.01); *H01H 3/0226* (2013.01); *H01H 17/16* (2013.01); *H01H 89/00* (2013.01); *H01H 9/16* (2013.01); *H01H 17/10* (2013.01); *H01H 2003/323* (2013.01)

(58) Field of Classification Search

CPC ..... G05B 9/02; H01H 3/022; H01H 3/0226; H01H 17/00; H01H 17/16; F16P 1/00; F16P 3/18; F16P 3/20; F16P 3/22; F16P 3/24

See application file for complete search history.

(56) References Cited

U.S. PATENT DOCUMENTS

| | | | | |
|---|---|---|---|---|
| 5,730,170 | A * | 3/1998 | Sanchez | F16K 17/383 137/554 |
| 7,022,930 | B2 * | 4/2006 | Hall | H01H 3/0226 200/334 |
| 8,089,012 | B2 * | 1/2012 | Mohtasham | H01H 3/42 200/334 |
| 9,912,136 | B1 * | 3/2018 | Federowicz | H02G 7/06 |
| 2002/0170811 | A1 | 11/2002 | Hall et al. | |

(Continued)

FOREIGN PATENT DOCUMENTS

| | | | |
|---|---|---|---|
| JP | S5781976 | A | 5/1982 |
| JP | 2004204933 | A | 7/2004 |
| KR | 20060012465 | A | 2/2006 |

(Continued)

*Primary Examiner* — Vanessa Girardi

(74) *Attorney, Agent, or Firm* — Renaissance IP Law Group LLP

(57) ABSTRACT

Provided are an emergency stop apparatus including a switch unit installed in a work space, electrically connected to a facility, and operable by pulling and a wire which is disposed in the work space so that tension is applied and of which at least one side is detachably mounted on the switch unit and an emergency stop method for quickly stopping the facility at a desired position within the work space in a manner of pulling or pushing the wire.

11 Claims, 6 Drawing Sheets

(56) References Cited

U.S. PATENT DOCUMENTS

2009/0083956 A1* 4/2009 Ulfik ..... G01L 5/047
24/68 D

FOREIGN PATENT DOCUMENTS

| | | | |
|---|---|---|---|
| KR | 200419121 | Y1 | 6/2006 |
| KR | 20060108978 | A | 10/2006 |
| KR | 20110038787 | A | 4/2011 |
| KR | 200464758 | | 1/2013 |

* cited by examiner

EMERGENCY STOP APPARATUS AND METHOD

CROSS-REFERENCE TO RELATED APPLICATION

This application claims priority to Korean Patent Application No. 10-2017-0023117 filed on Feb. 21, 2017 and all the benefits accruing therefrom under 35 U.S.C. § 119, the contents of which are incorporated by reference in their entirety.

BACKGROUND

The present disclosure relates to an emergency stop apparatus and method, to an emergency stop apparatus and method, which are capable of quickly stopping a facility at a desired position in a work space.

Each of processes for manufacturing a semiconductor or a display device is performed in each of process facilities that are disposed to provide an optimal condition for the progress of the corresponding process. The process facilities are complicated in mechanism and expensive in installation and operation. Also, the process facilities are quite complicated in manipulation process for stopping the operation. Thus, such a process facility essentially includes an emergency stop switch for emergently stopping an operation thereof.

The emergency stop switch may be installed with a simple and intuitive structure in a main body of the facility so that the emergency stop switch operates as quickly as possible.

For example, following Patent Document 1 relates to an emergency stop unit that includes a switch for stopping an entire line and a switch for stopping an individual device so that a worker may operate the switches in accordance with a situation. Also, Patent Document 2 relates to an EMO switch that is configured to stop an operation of a semiconductor manufacturing apparatus in a state in which all of a plurality of push buttons are pressed, thereby preventing an erroneous operation of a worker from occurring. Also, Patent Document 3 relates to an emergency off unit that includes a button cover to prevent a button from being pressed accidentally by a worker.

However, when the worker is located far from a main body of a process facility, there is a situation in which the operation of the process facility has to be stopped emergently. In accordance with Patent Documents 1, 2, and 3, when the worker is located far from the main body of the process facility, it is impossible to emergently stop the operation of the process facility.

Following Patent Document 4 relates to an emergency off system including a portable EMO switch that is capable of generating a wireless signal to stop an operation of a process facility. In accordance with Patent Document 4, in an emergency situation, the worker may stop the operation of the process facility by pressing the portable EMO switch at any position.

However, the emergency off system disclosed in Patent Document 4 has an inconvenience in that the worker has to directly carry the portable EMO switch, and also, the worker should be careful so that the portable EMO switch is not pressed while the worker manipulates the process facility or carries the portable EMO switch.

SUMMARY

The embodiment of the present invention disclosure provides an emergency stop apparatus and method, which are capable of quickly stopping a facility at all positions in a work space without additionally installing a switch unit.

The embodiment of the present invention disclosure also provides an emergency stop apparatus and method, which are capable of being quickly and easily manipulated by a worker.

The embodiment of the present invention disclosure also provides an emergency stop apparatus and method, which are capable of being intuitively manipulated by a worker in an emergency situation.

In accordance with an exemplary embodiment, an emergency stop apparatus includes: a switch unit installed in a work space, electrically connected to a facility, and operable by pulling; and a wire which is disposed in the work space so that tension is applied and of which at least one side is detachably mounted on the switch unit.

The switch unit may be provided in plurality to be spaced apart from each other, and the wire may be connected between the switch units.

The emergency stop apparatus may further include a dummy unit which is installed in the work space so as to be spaced apart from the switch unit and on which the other side of the wire is detachably mounted.

The emergency stop apparatus may further include a safety spring mounted to be connected between the dummy unit and the wire.

The emergency stop apparatus may further include a guide unit installed in the work space, wherein the wire may be disposed to pass through the guide unit, and at least one end of the wire may be detachably mounted on the switch unit.

The guide unit may be provided in plurality so that the plurality of guide units are installed along a moving line of a worker or installed around an entire space in which the worker is movable, and the wire may come into contact with at least one guide unit to support the guide unit.

The emergency stop apparatus may further include a connection unit mounted to be connected between the wire and the switch unit and adjustable in length in the mounted direction, wherein the wire may be detachably mounted on the switch unit through the connection unit.

The switch unit may include: a switch body electrically connected to the facility; a stop switch stretchably mounted on the switch body to turn on the switch body by the pulling; and a wire hook disposed on end of the stop switch.

The switch unit may include: a recovery switch stretchably mounted on the switch body to turn off the switch body by pressing; and an operation display part mounted on the switch body to display a pulled state of the stop switch, wherein, when the stop switch is pulled by force that is above reference force by the wire, the switch body may be turned on, and when the recovery switch is pressed, the switch body may be turned off.

The facility may be provided in plurality, and the switch body may integrally control one group in which the plurality of facilities are bundled.

The facility may be provided in plurality, the switch body may be provided in plurality to correspond to the number of facilities, and each of the switch bodies may individually control one facility or control a group of the plurality of facilities.

The guide unit may include a ring disposed at a height at which the switch unit is installed and providing a passage through which the wire passes, and the wire may be disposed to pass through the passage of the ring.

In accordance with another exemplary embodiment, an emergency stop method for stopping a facility installed in a work space includes: providing a switch body electrically connected to the facility and a wire which is disposed in the work space so that tension is applied and of which one end is connected to the switch body; operating the facility; and operating the switch body by using the wire to stop the facility.

A stop switch may be mounted on one side of the switch body, and the wire may be connected to the stop switch, wherein the stopping of the facility may include: pulling or pushing the wire to pull the stop switch; turning on the switch body when the stop switch is pulled by force that is above reference force; and outputting a stop signal from the switch body to the facility.

The facility may be provided in plurality, and the stopping of the facility may include operating one switch body by using one wire to stop all the plurality of facilities.

The facility may be provided in plurality, the switch body may be provided in plurality to correspond to the number of facilities, and the wire may be provided in plurality to be respectively connected to the switch bodies, wherein the stopping of the facility may include selectively operating the switch bodies by using the respective wires to individually stop the plurality of facilities or stop a group of the plurality of facilities, or operating all the switch bodies by using the respective wires to stop all the plurality of facilities.

A recovery switch may be mounted on the other side of the switch body, wherein, after the stopping of the operation of the facility, the emergency stop method may further include: pressing the recovery switch to turn off the switch body; and outputting a recovery signal from the switch body to the facility.

BRIEF DESCRIPTION OF THE DRAWINGS

Exemplary embodiments can be understood in more detail from the following description taken in conjunction with the accompanying drawings, in which.

DETAILED DESCRIPTION OF EMBODIMENTS

Figure 1:
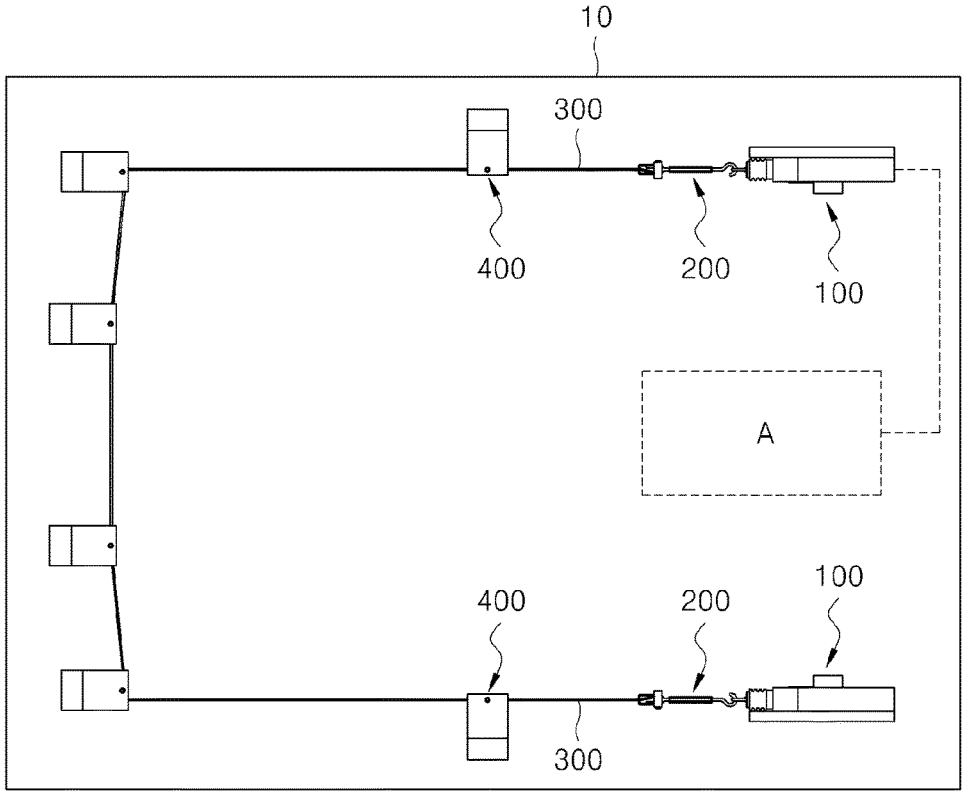
FIG. 1 is a schematic view illustrating a state in which an emergency stop apparatus is installed in a work space in accordance with an exemplary embodiment.

Hereinafter, specific embodiments will be described in detail with reference to the accompanying drawings. The embodiment of the present invention may, however, be embodied in different forms and should not be construed as limited to the embodiments set forth herein. Rather, these embodiments are provided so that this disclosure will be thorough and complete, and will fully convey the scope of the embodiment of the present invention to those skilled in the art. In the figures, the dimensions of layers and regions are exaggerated for clarity of illustration. Like reference numerals refer to like elements throughout.

Figure 2:
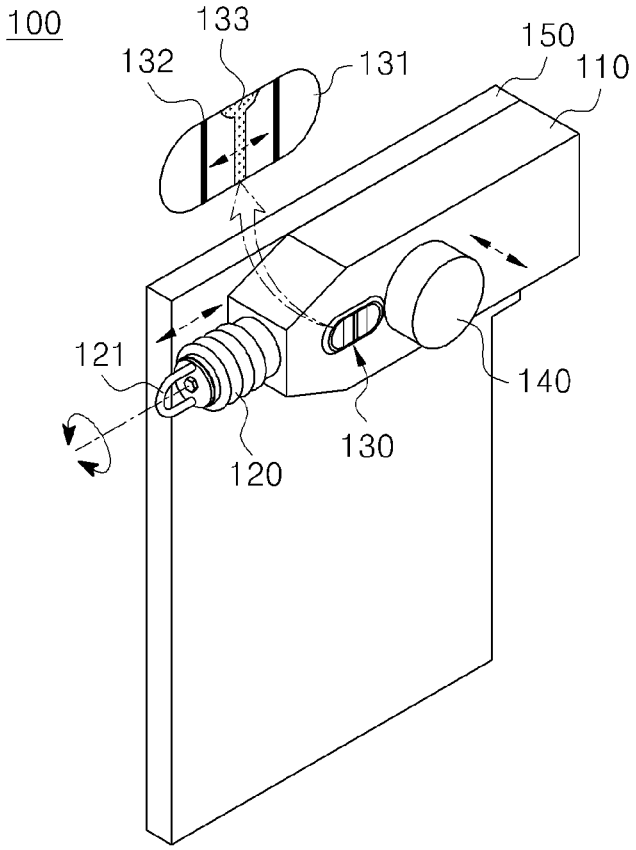
FIG. 2 is a schematic view of a switch unit in accordance with an exemplary embodiment.
Figure 3:
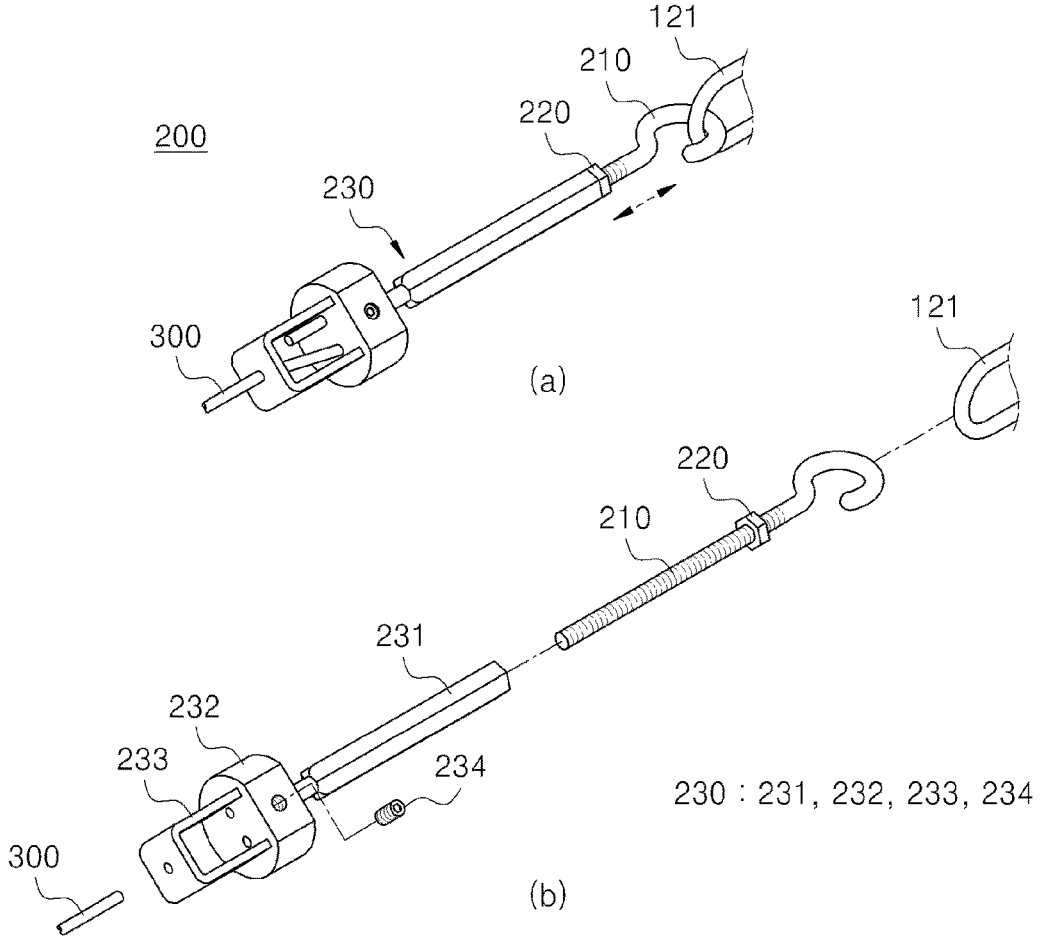
FIG. 3 is a schematic view of a connection unit in accordance with an exemplary embodiment.

FIG. 1 is a schematic view illustrating a state in which an emergency stop apparatus is installed in a work space in accordance with an exemplary embodiment. FIG. 2 is a schematic view of a switch unit in accordance with an exemplary embodiment. FIG. 3 is a schematic view of a connection unit in accordance with an exemplary embodiment.

Figure 4:
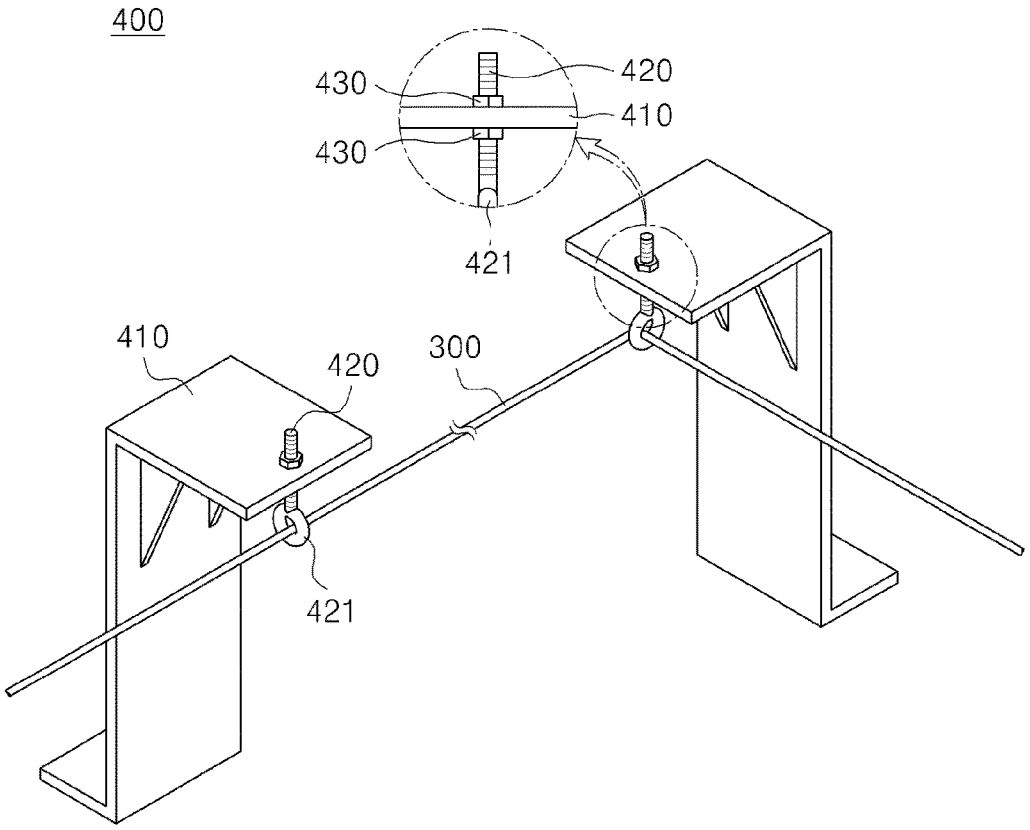
FIG. 4 is a schematic view of a guide unit in accordance with an exemplary embodiment.
Figure 6:
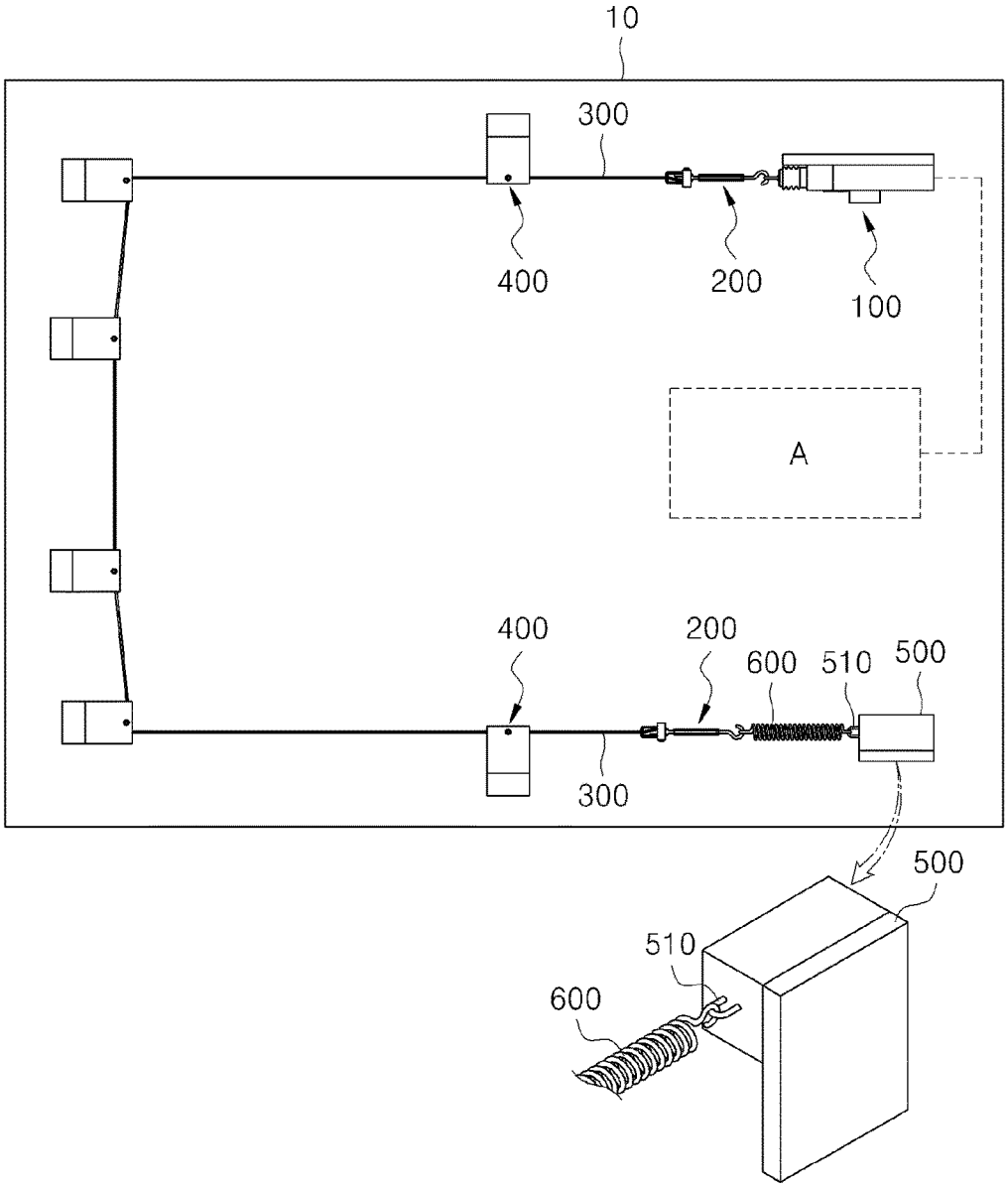
FIG. 6 is a schematic view illustrating a state in which an emergency stop apparatus is installed in a work space in accordance with a modified embodiment.

FIG. 4 is a schematic view of a guide unit in accordance with an exemplary embodiment. FIG. 6 is a schematic view illustrating a state in which an emergency stop apparatus is installed in a work space in accordance with a modified embodiment.

Referring to FIG. 1, an emergency stop apparatus in accordance with an exemplary embodiment includes a switch unit 100 installed in a work space 10, electrically connected to a facility A, and operable by pulling force that is above reference force and a wire 300 disposed in the work space 10 in a state of being tensioned so that tension less than the reference force is applied and having at least one side detachably mounted on the switch unit 100.

Also, the emergency stop apparatus may further include a connection unit 200 mounted to be connected between the wire 300 and the switch unit 100 and adjustable in length in the mounted direction so that the tension applied to the wire 300 is adjustable in intensity and at least one guide unit 400 installed in the work space 10 to guide a path of the wire 300.

The work space 10 may be a space in which the facility A, for example, a process facility for manufacturing a semiconductor or a display device is installed and may include a moving line along which the worker moves around the facility to manipulate the facility and all spaces around the facility, in which the worker is movable with regard to the facility or the process. The facility operates in the work space 10 to perform various processes for manufacturing the semiconductor or the display device.

Also, the work space 10 may include a space in which various facilities for performing various processes in various industry fields and a surrounding space. The facility A may be installed at one side of the work space 10, and one or plurality of facilities may be provided. The emergency stop apparatus in accordance with an exemplary embodiment may be installed around the outside of the facility.

The switch unit 100 may be installed in the work space and electrically connected to the facility to operate by the pulling. For example, when the stop switch 120 that will be described below is pulled by the wire 300, the switch unit 100 may generate a signal for emergently stopping the operation of the facility to output the signal to the facility.

The switch unit 100 may be provided in plurality, and the plurality of switch units 100 may be installed to be spaced apart from each other. For example, two or less of switch units 100 may be provided. In more detail, two switch units 100 may be provided to be spaced part from each other to form one pair. Alternatively, one switch unit 100 may be provided.

Referring to FIG. 2, the switch unit 100 in accordance with an exemplary embodiment may include a switch body 110, a stop switch 120, a wire hook 121, an operation display part 130, a recovery switch 140, and a support panel 150.

The switch body 110 may be installed at a predetermined height so that at least one of upper and lower limbs of the worker comes into contact with the switch body 110. The switch body 110 may be electrically connected to the facility A. The switch body 110 may output a stop signal for emergently stopping the facility A in a turn-on state. The switch body 110 may output a recovery signal for releasing the emergency stop state of the facility A in a turn-off state.

The switch body 110 and the facility A may be connected to each other in a wired communication manner or a wireless communication manner. The facility A may receive the stop signal from the switch body 110 and then immediately stopped in operation. The facility A may receive the recovery signal from the switch body 110 and then re-operate or be converted into an operation standby state.

When one facility A is provided, one switch body 110 may be installed. When the facility A is provided in plurality, one switch body 110 may be installed, and thus, the facilities may be bundled into one group and integrally controlled by the switch body 110.

Alternatively, when the facility A is provided in plurality, the switch body 110 may be provided in plurality to correspond to the number of facilities A. Here, when the number of switch bodies 110 corresponds to the number of facilities A, the switch bodies 110 may individually control the facilities A, respectively. Also, the number of switch bodies 110 is less than that of facilities A, the plurality of facilities A may be bundled into a plurality of groups, and each of the groups may be controlled by each of the switch bodies 110.

The stop switch 120 may be stretchably mounted on one side of the switch body 110. The stop switch 120 may operate by pulling the wire 300 to turn on the switch body 110. The stop switch 120 may have, for example, a structure that is stretchable by a spring or an oil pressure. The stop switch 120 may protrude to the outside of the switch body 110 in the pulled state and be extended in length. When the pulling is released, the stop switch 120 may be restored to a length (initial length) before being pulled by elastic restoring force. When the switch body 110 is turned on by the pulling of the stop switch 120, the switch body 110 may be maintained in the turn-on state even though the pulling of the stop switch 120 is released.

The stop switch 120 may be smoothly stretched and restored when the stop switch 120 is manipulated by, for example, force of 12.75 kgf or less or force of 125 N or less. Here, when the stop switch 120 may turn on the switch body 110 when being pulled by force above the reference force by the wire 300. That is, when the stop switch 120 is pulled by force above the reference force or force of 12.75 kgf or less or force of 125 N or less, the stop switch 120 may protrude to the outside of the switch body 110 to turn on the switch body 110. Thereafter, when the force pulling the stop switch 120 is removed, the stop switch 120 may be restored to a length before being pulled. At this time, the switch body 110 may be maintained in the turn-on state. The reference force may be a relative value with minimum tension applied to the wire 300 as a reference value so that the wire 300 is coupled to the top switch and pulled tightly without the worker pulls or pushes the wire 300.

The reference force may be, for example, force of 3 kgf or more or force of 29.4 N or more. The above-described value corresponds to a predetermined tension value to which the worker directly pulls or pushes the wire 300 by using the upper and lower limbs in an emergency situation. The stop switch 120 may not operate to turn on the switch body 110 when being pulled by force less than the reference force. Thus, malfunction of the switch body 110 may be prevented.

The wire hook 121 may be disposed on an end of the stop switch 120. Thus, the wire may be detachably mounted on the stop switch 120 through the wire hook 121. The structure of the wire hook 121 is not specifically limited. For example, a structure such as an eye bolt or a ring bolt may be applied to the wire hook 121.

The operation display part 130 may be a kind of gauge mounted on the switch body 110 and serve to display a variation in force applied to the stop switch 120 as time information. That is, the operation display part 130 may be a gauge for displaying the pulled state of the stop switch 120. The operation display part 130 may be constituted by a display screen 131, reference lines 132, and an operation pin 133.

The display screen 131 is spaced apart from one side of the switch body 110 to the recovery switch 140 and mounted on one surface of the switch body 110 to extend in the stretching direction of the stop switch 120. The reference lines 132 may be spaced apart from each other in the stretching direction of the stop switch 120 and respectively disposed on both edges of the display screen 131. The operation pin 133 may be mounted on the display screen 131 so that the operation pin 133 is disposed at a center between the reference lines 132. Also, the operation pin 133 may move in the stretching and restoring direction of the stop switch 120 on the display screen 131 according to the pulling of the stop switch 120 or the release of the pulling of the stop switch 120. The operation pin 133 may be disposed inside the reference lines 132 while the stop switch 120 is pulled by force less than the reference force and then move to the outside of the reference lines 132 when the stop switch 120 is pulled by force greater than the reference force.

The operation display part 130 may adjust a zero point by adjusting the position of the operation pin 133 in a manner in which a separate dial (not shown) or the stop switch 120 rotates. A structure and manner for adjusting the zero point of the operation display part 130 is not specifically limited. For example, structures and manners for adjusting zero points of various gauges, which are used in industrial fields, may be applied.

For example, when the wire 300 is mounted on the stop switch 120 and then adjusted in length by using the connection unit 200 that will be described later so that the wire 300 is tight, predetermined force corresponding to the tension applied to the wire 300 may be applied to the stop switch 120 so that the tension state of the wire 300 is maintained without the worker pulls or pushes the wire 300. That is, minimum tension may be always applied to the wire 300 so that the wire 300 is tightly pulled. That is, the stop switch 120 may be pulled by the force less than the reference force without the worker pulls or pushes the wire 300, and also, the operation pin 133 may be disposed close to the reference lines 132. Thus, after the wire 300 and the stop switch 120 are completely coupled to each other, and the tension of the wire 300 is completely adjusted, the zero point of the operation pin 133 may be adjusted to locate the operation pin 133 at the center between the reference lines 132. Thereafter, the operation display part 130 may accurately display the pulled state of the stop switch 120.

The recovery switch 140 is stretchably mounted on the switch body 110 and serves to turn off the switch body 110 by pushing thereof. When the pushing of the recovery switch 140 is released, the recovery switch 140 is restored to its original state by elasticity. When the switch body 100 is turned off by the pressing of the recovery switch 140, the force pressing the recovery switch 140 may be removed to allow the recovery switch 140 to protrude to its original state. Thus, the recovery switch 140 may be maintained in the turn-off state even though the recovery switch 140 is restored.

The support panel 150 may be installed to be attached to the facility or to be spaced apart from the facility and may extend up to a height at which the switch body 110 is intended to be installed. The switch body 110 may be installed to be supported by the support panel 150.

Hereinafter, the wire 300 will be described before the connection unit 200 is described. Referring to FIG. 1, the wire 300 may be disposed in the work space 10 so that the tension is applied, and at least one side of the wire 300 may be detachably mounted on the wire hook 121 of the switch unit 100. In more detail, the wire 300 may be mounted to be connected between the switch units 100. Here, at least one end of both ends of the wire 300 may be detachably mounted on one switch unit 100.

When two switch units 100 are provided, the other end of the wire 300 may be detachably mounted on the other switch unit 100 or may be detachably mounted on a dummy unit 500 provided in the work space 10 so as to be spaced apart from the switch unit 100. When the other end of the wire 300 is mounted on the dummy unit 500, the other switch unit 100 may be mounted at a predetermined point between one end and the other end of the wire 300.

Referring to FIG. 6, when the number of switch unit 100 is one, the stop switch 120 of the switch unit 100 may be connected to one end of the wire 300. The other end of the wire 300 may be mounted on the dummy unit 500 that is installed in the work space 10 so as to be spaced apart from the switch unit 100. Here, a safety spring 600 may be mounted to be connected between the dummy unit 500 and the wire 300. The wire 300 and the safety spring 600 may be directly mounted on each other or may be mounted through the connection unit 200.

For example, in environments in which the two switch units are not used in relation to the space restriction of the work space 10 or the control of the facility, the one switch unit 100 and the dummy unit 500 may be used to construct the emergency stop apparatus.

The dummy unit 500 may be provided as a plate having a predetermined shape and extend to a height at which the switch unit 100 is installed. A ring 510 may be provided in the dummy unit 500 so that the safety spring 600 is detachable. The safety spring 600 may connect the wire 300 to the ring 510 instead of the connection unit 200. Alternatively, the safety spring 600 may be connected in series with the connection unit 200 and be connected between the wire 300 and the ring 510. The emergency stop apparatus may be constructed in various manners in addition to the above-described structure in accordance with a modified example.

In the connection structure in accordance with an exemplary embodiment and a comparative example, while the wire 300 is pulled or pushed by the worker, the stop switch 120 of the switch unit 100 may be pulled. That is, a region in which the switch unit 100 is physically manipulated by the wire 300 may be expanded to the entire work space 10. Also, a region that is directly handled by the pair of switch unit 100 by the wire 300 may be expanded to the entire work space 10.

Particularly, even though any point of the wire 300 is pulled or pushed by the above-described structure of the wire 300, the stop switch 120 of the switch unit 100 that is close to a corresponding point of the pair of switch units 100 may be smoothly pulled.

When the switch body 110 is provided in plurality, the wire 300 may be provided to correspond to the number of switch bodies 110, and the plurality of wires 300 may be respectively connected to the switch bodies 110.

The wire 300 has to be in the tight tension state, the worker so that the worker is capable of immediately pulling the stop switch 120 when being pulled or pushed. Thus, the connection unit 200 that is adjustable in length may be mounted to be connected between the wire and the stop switch 120, and the connection unit may be adjusted in length to adjust an intensity of the tension applied to the wire 300.

(a) of FIG. 3 is a view illustrating a coupled state of the connection unit, and (b) of FIG. 3 is a view illustrating a disassembled state of the connection unit.

Referring to FIG. 3, the connection unit 200 may include a hook body 210, a fixing nut 220, and a wire coupling tool 230. The hook body 210 may have a bar shape that extends by a predetermined length in one direction, and a hook may be provided on one end of the hook body 210. Also, a screw thread may be disposed on a remaining outer circumferential surface of the hook body 210. The fixing nut 220 may be coupled to the screw thread of the hook body 210.

The wire coupling tool 230 may be screw-coupled to the hook body 210 so that at least a portion of the wire coupling tool 230 overlaps the hook body 210. The wire coupling tool 230 may be adjustable in length in the extension direction of the connection unit 200 in accordance with the overlapping degree thereof. The wire coupling tool 230 may include a nut part 231 extending by a predetermined length in one direction, a hold part 232 disposed on an end of the nut part 231 to provide a passage through which the wire 300 passes, a wire support 233 mounted on the hold part 232 at a side that is opposite to the nut part 231 by using the hold part 232 as a center and having a wire support hole, and a fixing bolt 234 fixing the wire 300 that passes through the hold part 232 to pass through the passage.

The wire 300 may be inserted into the passage of the hold part 232 after passing through the wire support hole and then fixed by the fixing bolt 234. Thus, the wire 300 may be coupled to the hold part 232. Thereafter, while the hook body 210 is inserted into the nut part 231 and then screw-coupled, the overlapping degree between the nut part 231 and the hook body 210 may be adjusted to adjust a length of the connection unit 200. When the length of the connection unit 200 is completed, the fixing nut 220 may be closely attached to the nut part 231 to fix the nut part 231 to the hook body 210. Thereafter, the hook of the hook body 210 may be hooked on the wire hook 121 of the stop switch 120 to detachably couple the connection unit 200 to the stop switch 120. Thus, the wire 300 may be detachably mounted on the stop switch 120 through the connection unit 200. Also, the connection unit 200 may be adjusted in length in the direction in which the connection unit 200 is mounted to adjust the tension of the wire 300.

The guide unit 400 may be provided in plurality. Thus, the plurality of guide units 400 may be installed along a moving line along which the worker moves or installed around the entire space in which the worker is movable. The guide 300 may be disposed to pass through the guide units 400 and then come into contact with at least one guide unit 400 and be supported so as to be converted in path.

Referring to FIG. 4, the guide unit 400 may include a ring 420 that is disposed at the installed height of the switch unit 100 and having a passage through which the wire 300 is capable of passing and a bracket 410 which is installed in the work space 10 and in which the ring 421 is mounted and supported.

The bracket 401 is not specifically limited in structure and shape. As shown in the drawing, a plurality of plates may be coupled to each other to provide a three-dimensional structure. The ring 420 may include a ring-shaped head part 421 and a body part having a bolt shape except for the head part 421. The body part may pass through one side of the bracket 410 and then be screw-coupled to the bracket 410. Here, a plurality of nuts 430 may be disposed on an outer circumferential surface of the body part. Also, each of the plurality of nuts 430 may be closely attached to each of the brackets 410 to fix the body part. The wire 300 may be disposed to pass through the passage of the head part 421. Here, the positions of the head part 421 on the plane or in the space may be determined in consideration of a refractive index and a height of the wire 300. Thus, the wire 300 may smoothly move without being broken.

The guide unit 400 may be installed at a plurality of positions that are spaced apart from each other along the moving line of the worker or the space in which the worker is movable within the work space. The wire 300 may be supported by the guide unit 400, and the path of the wire 300 may be guided by the guide unit 400. Alternatively, the guide unit 400 may be installed at a plurality of positions that are spaced apart from each other to surround the moving line of the worker or the space in which the worker is movable within the work space. The wire 300 may be supported by the guide unit 400, and the path of the wire 300 may be guided by the guide unit 400. The path of the wire 300 is called a safety line. All positions within the work space 10 may be adjacent to the safety line according to a layout of the safety line.

A process of installing the emergency stop apparatus in accordance with an exemplary embodiment will be described as follows.

First, the pair of switch units 100 are installed in the work space, and then, the wire 300 successively passes through the rings 420 of the guide units 400 and is disposed within the work space 10 to connect the switch units 100 to each other through the rings 420. Here, the wire 300 may not be in the tightly pulled state. Thereafter, the connection units 200 are coupled to both ends of the wire 300, respectively. Then, one connection unit 200 is mounted on one switch unit 100. Thereafter, the other connection unit 200 is mounted on the other switch unit 100. Here, the connection unit 200 may be adjusted in length so that the wire 300 is tightly pulled. That is, in the state in which the emergency stop apparatus is installed in the work space, the wire 300 may be maintained in the tightly pulled state so that the tension less than the reference force is applied to the wire 300. Thereafter, the zero point of the stop switch 120 is adjusted to complete the installation of the emergency stop apparatus. Thus, while the worker performs the process, the worker may easily manipulate the pair of switch units 100 through the simple operation in which the worker pulls the wire 300 at all positions within the work space in which the worker is movable.

The completely installed emergency stop apparatus serve to emergently stop the operation of the facility during the process. Particularly, although the minimum number of switch units 100 is installed in the work space 10 (i.e., the installed number of switch units 100 is minimized into one or two units) by using wire, accessibility to the switch unit 100 at all positions within the work space 10 may be significantly improved.

Figure 5:
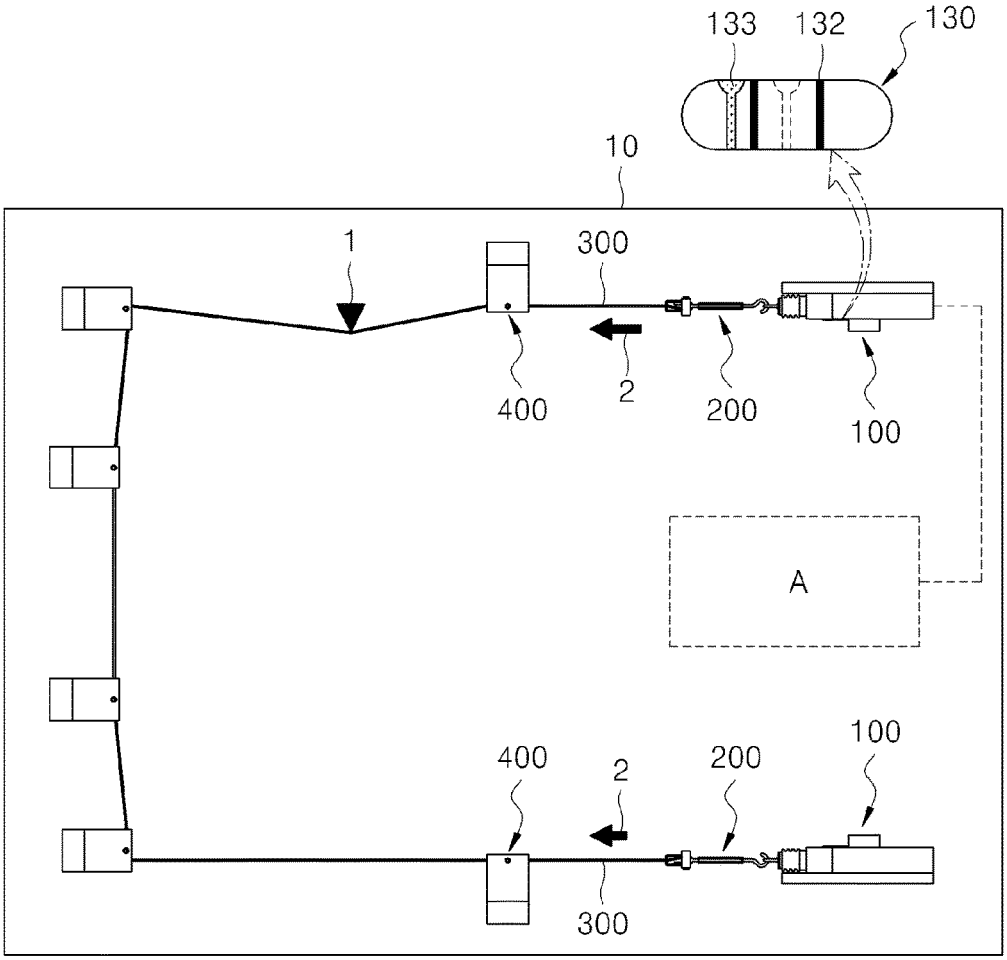
FIG. 5 is a schematic view illustrating an example of a state in which the emergency stop apparatus operates in accordance with an exemplary embodiment.

FIG. 5 is a schematic view illustrating an example of a state in which the emergency stop apparatus operates in accordance with an exemplary embodiment. Referring to FIG. 5, a method for operating the emergency stop apparatus in accordance with an exemplary embodiment will be described.

While the facility operates, for example, in an emergency situation in which the worker's body gets caught in the facility, or the process is abnormally performed, the worker pulls the wire 300 passing therearound at force that is above the reference force. Here, the reference force means a degree of force, which is enough to turn on the switch body 100 in the state in which the wire 300 is coupled to the stop switch 120 so as to be tightly pulled. When one point 1 of the wire 300 is pulled, each of both ends of the wire 300 may be pulled toward the one point 1. Thus, as described above, when the wire 300 is pulled (2), the stop switch 120 may be pulled by force that is above the reference force to allow the operation pin 133 to move to the outside of the reference lines 132 and allow the stop switch 120 to turn on the switch bodies 110 so that the facility is emergently stopped. Then, when the emergency situation is released, the recovery switch 140 may be pressed to turn off the switch body 110.

Hereinafter, installation and operation methods of the conventional emergency stop switch in accordance with a comparative example and the emergency stop apparatus in accordance with an exemplary embodiment will be compared to be described.

For example, in accordance with the related art, the emergency stop switch is installed at each of the positions in the moving line of the workers for operating the facility and within the work space in which the worker is movable. This not only complicates design elements and operation methods of the facility, but also more complicatedly makes an operation mechanism for the emergency stop switch.

On the other hand, in accordance with an exemplary embodiment, the emergency stop switch may be installed to cover the entire work space by using the two switch units 110 and the one wire 300. Thus, the installation and operation of the facility may be simpler than those in accordance with the related art, and the operation mechanism related to the emergency stop may also be simplified. Also, since it is possible to quickly operate the switch unit 100 at any position within the work space, stability in all positions within the work space may be secured, and the layout of the safety line may be freely constructed in the work space without burden of cost increase.

Also, in accordance with the related art, a reason in which the worker carries an EMO switch is because whether the emergency stop of the facility is possible is determined whether the worker carries a portable EMO switch. On the other hand, in accordance with an exemplary embodiment, the facility may be emergently stopped only by pulling or pushing the wire 300 installed around the work space 10 without the worker carries the portable EMO switch.

Particularly, unlike the related art, in accordance with an exemplary embodiment, since the worker operates the stop switch by pulling or pushing the wire by using the worker's upper or lower limb, it is easier and quicker to cope with the emergency situation than the method for operating the switch by directly pressing the switch.

As described above, the emergency stop apparatus in accordance with an exemplary embodiment may secure the safe work space within a predetermined range only by the simple installation structure using the minimum number of switch units and the wire. Also, the emergency stop apparatus may be operable in all positions within the work space, and even though the pulling position of the wire is biased to any one side, since the stop switch is connected to each of both the ends of the wire, the emergency stop apparatus may operate safely.

Hereinafter, an emergency stop method in accordance with an exemplary embodiment will be described. Here, the duplicate of the foregoing description will be omitted or briefly explained.

The emergency stop method in accordance with an exemplary embodiment is a method for stopping a facility installed in a work space by using the above-described emergency stop apparatus and includes a process of providing a switch body electrically connected to the facility and a wire which is disposed in the work space so that tension is applied and of which one end is connected to the switch body, a process of operating the facility, and a process of operating the switch body by using the wire to stop the facility.

First, the switch body 110 electrically connected to the facility A and the wire 300 which is disposed in the work space 10 and of which the one end is connected to the switch body 110 so that the tension is applied are provided. Here, the stop switch 120 may be mounted on one side of the switch body 110, and the wire 300 may be connected to the emergency switch 120. The facility A and the switch body 110 may be provided in at least one or more, and each of the switch bodies 110 may be electrically connected to each of at least one or ore facilities A. A recovery switch 140 may be mounted on the other side of the switch body 110. Thereafter, the facility A operates.

While the facility A operates, if it is intended to emergently stop the operation of the facility A in accordance with needs of the worker, the switch body 110 may operate by the wire 300 to stop the facility A. For example, when the wire 300 is pulled or pushed to pull the stop switch 120, the stop switch 120 may be pulled by force that is above reference force, and thus, the switch body 120 may be turned on. Here, a stop signal may be outputted from the switch body 110 to the facility A. Thus, the facility A may be immediately stopped.

Here, in the structure in which one switch body 110 is electrically connected to the plurality of facilities A, one switch body 110 may operate by one wire 300 to stop all the plurality of facilities A.

Also, in the structure in which the plurality of switch bodies 110 one-to-one correspond to each other and are electrically connected to each other, the switch bodies 110 may selectively operate by the respective wires 300 to individually stop the plurality of facilities A, or all the switch bodies 110 may operate by the respective wires 300 to stop all the plurality of facilities A.

Also, in the structure in which the plurality of facilities A do not one-to-one correspond to the plurality of switch bodies 110, and the number of facilities A is greater than that of switch bodies 110 so that any one group constituted by the plurality of facilities A is electrically connected to at least one switch body 110, the switch bodies 110 may selectively operate by the respective wires 300 to individually stop the plurality of facilities A or stop the group, and all the switch bodies 110 may operate by the respective wires 300 to stop all the plurality of facilities A.

After the process of stopping the operation of the facility A, when the emergency stop situation is released by the process schedule or the worker's judgment, a process of pressing the recovery switch 140 to turn of the switch body 110 and a process of outputting a recovery signal from the switch body 110 to the facility A may be performed. Thereafter, the facility A may receive the recovery signal and then re-operate or be converted into an operation standby state.

In accordance with the exemplary embodiment, the facility may be quickly stopped at any position in the work space without additionally installing the switch unit. In detail, the pair of switch units connected to the wire may be quickly and easily manipulated through the intuitive operation of pulling or pushing the wire installed around the work space at all positions at which the worker is movable and which includes the worker's moving line to quickly stop the facility at all positions within the work space.

While the process facility operates to manufacture, for example, the semiconductor or the display device, even though the worker is located far from the switch unit, the process facility may be emergently stopped by pulling or pushing the wire connected to the switch unit. Thus, there may be no inconvenience that the worker has to always equip the portable switch with the worker's body like the related art, and the process facility may be quickly stopped by pulling or pushing the wire without performing the operations in which the worker moves to the position, at which the switch is installed, or takes out or finds the switch.

Particularly, since the worker easily pushes or pulls the wire regardless of whether the worker uses the upper or lower limb, the worker may more effectively cope with the emergency situation.

Although the deposition apparatus and method have been described with reference to the specific embodiments, they are not limited thereto. It is to be noted that the configurations and the methods disclosed in the above embodiments of the present invention may be combined or cross-applied to each other and modified in various forms, and these modifications may be considered within the scope of the embodiment of the present invention. Therefore, it will be readily understood by those skilled in the art that various modifications and changes can be made thereto without departing from the spirit and scope of the embodiment of the present invention defined by the appended claims.

What is claimed is:

1. An emergency stop apparatus comprising:

a switch unit installed in a work space and electrically connected to a facility;

a wire which is disposed in the work space so that tension is applied and of which at least one side is mounted on the switch unit; and a connection unit mounted to be connected between the wire and the switch unit and adjustable in length in a mounted direction, wherein the switch unit comprises:

a switch body electrically connected to the facility;

a stop switch stretchably mounted on the switch body to turn on the switch body by pulling the wire;

a recovery switch stretchably mounted on the switch body to turn off the switch body by pressing, an operation display part mounted on the switch body to display a pulled state of the stop switch; and a wire hook disposed on end of the stop switch, wherein the switch body maintains a turn-on state even when the stop switch is restored to an original state by releasing the stop switch in the turn-on state, and the switch body maintains a turn-off state even when the recovery switch is restored to an original state by removing a pushing force from the recovery switch while in the turn-off state, the connection unit comprises a hook body caught by the wire hook and a wire coupling tool that couples an end of the wire, and the wire coupling tool comprises a holding part to provide a passage through which the wire passes, and a wire support mounted on the holding part and having a wire support hole.

2. The emergency stop apparatus of claim 1, wherein the switch unit is provided in plurality to be spaced apart from each other, and the wire is connected between the switch units.

3. The emergency stop apparatus of claim 1, wherein the connection unit further comprises a nut part, and the holding part disposed on an end of the nut part.

4. The emergency stop apparatus of claim 1, further comprising a dummy unit which is installed in the work space so as to be spaced apart from the switch unit and on which the other side of the wire is mounted.

5. The emergency stop apparatus of claim 4, further comprising a safety spring mounted to be connected between the dummy unit and the wire.

6. The emergency stop apparatus of claim 1, further comprising a guide unit installed in the work space, wherein the wire is disposed to pass through the guide unit, and at least one end of the wire is mounted on the switch unit.

7. The emergency stop apparatus of claim 6, wherein the guide unit is provided in plurality so that a plurality of guide units are installed along a moving line of a worker or installed around an entire space in which the worker is movable, and the wire comes into contact with at least one guide unit.

8. The emergency stop apparatus of claim 6, wherein the guide unit comprises a ring disposed at a height at which the switch unit is installed and providing a passage through which the wire passes, and the wire is disposed to pass through the passage of the ring.

9. An emergency stop method for stopping a facility installed in a work space, the emergency stop method comprising:

providing a switch body electrically connected to the facility and a wire which is disposed in the work space so that tension k applied and of which one end is connected to the switch body;

operating the facility; and operating the switch body by using the wire to stop the facility;

wherein a stop switch k mounted to one side of the switch body, a recovery switch is mounted to the other side of the switch body, a wire hook is provided to an end of the stop switch, an operation display part for displaying a pulled state of the stop switch is mounted to the switch body, an adjustable connection unit comprising a holding part on one end and a hook body on an opposite end provides for coupling one end of the wire to the holding part and mounting of the connection unit to the wire hook whereby tension of the wire is adjusted by adjusting a length of the connection unit, and then a zero point of the operation display part is adjusted, wherein stopping the facility comprises:

pulling the stop switch by pulling or pushing the wire;

turning-on the switch body when the stop switch is pulled by a force of a reference force or more; and maintaining a turn-on state of the switch body after releasing the stop switch, wherein, after stopping the facility, the emergency stop method further comprises:

turning-off the switch body by pushing the recovery switch; and maintaining a turn-off state of the switch body after restoring the recovery switch to an original state.

10. The emergency stop method of claim 9, in stopping the facility, when the switch body is turned-on, a stop signal is output from the switch body to the facility.

11. The emergency stop method of claim 10, after stopping the facility, when the switch body is turned-off, a recovery signal is output from the switch body to the facility.

* * * * *